US005615884A

United States Patent [19]

Modglin

[11] Patent Number: 5,615,884

[45] Date of Patent: Apr. 1, 1997

[54] REAR ALIGNMENT GOLF PUTTER

[76] Inventor: Donald D. Modglin, 924 Rodney Dr., Nashville, Tenn. 37205

[21] Appl. No.: 336,386

[22] Filed: Nov. 8, 1994

[51] Int. Cl.[6] ..... A63B 53/04

[52] U.S. Cl. ..... 473/238; 473/251

[58] Field of Search ..... 273/163 R, 164.1, 273/164.2; 473/238, 251

[56] References Cited

U.S. PATENT DOCUMENTS

| | | | |
|---|---|---|---|
| 245,439 | 8/1977 | Thiel | 273/163 R |
| 5,046,740 | 9/1991 | D'Eath | 273/164.1 |
| 5,072,941 | 12/1995 | Klein | 273/164.1 |
| 5,286,027 | 2/1994 | Koumarianos | 273/164.1 |

*Primary Examiner*—V. Millin
*Assistant Examiner*—Charles W. Anderson
*Attorney, Agent, or Firm*—Mark J. Patterson; Waddey & Patterson

[57] ABSTRACT

Disclosed herein is a golf putter designed to improve accuracy of putting by providing an alignment means on the putting head of the putter by which the putting head can be aligned with a line running from a point near the hole through the golf ball to a point substantially behind the golf ball. The alignment means extends towards the back of the putting head, which allows the putting head to be aligned with the center of the ball and the point behind the ball. The point behind the golf ball is closer to the ball than the point near the hole, thus providing for a more accurate alignment between the putting head and the line. Further, the alignment means is of a sufficient length to accurately align the putting head to the line. The device of the present invention includes a grip, a shaft, a putting head, and an alignment means. A preferred embodiment of the device of the present invention includes a grip, a shaft, a connecting arm, a putting head with a front section and a back section, a rear alignment notch and a front alignment gauge.

3 Claims, 3 Drawing Sheets

REAR ALIGNMENT GOLF PUTTER

BACKGROUND OF THE INVENTION

The present invention relates generally to a golf putter and more particularly to a putter which can be aligned using a point behind the golf ball.

It will be appreciated by both novice and experienced golfers that putting is a difficult aspect of the game of golf. A golfer must read the green to determine contours that will cause the ball to break fight or left. Putts of any significant distance rarely travel straight to the hole. Indeed, a shot directly at the hole is usually inaccurate. Thus, a golfer often chooses a spot to either side of the hole, depending on the contours of the green, at which to aim.

However, several problems with putting remain. For example, the putter must be aligned with the ball and with the point near the hole at which the ball is aimed. This alignment is needed to insure that the ball will start traveling on a true line to the point.

However, this alignment is difficult to achieve. It is difficult to align the putter so that the ball will start traveling on a line to the point near the hole. Golf putters typically have one or more notches on top of the head of the putter. These notches are used to align the putter with the center of the ball and with the line to the point near the cup. On a conventional putter, this notch is not very long. This makes it difficult to judge whether the notch is actually aligned with the line on which the ball must travel. On other conventional putters, the construction is such that the eyes see more than one linear notch, edge, or line pointing in the direction of the hole. This makes it difficult to align only one of such linear references.

This problem is exacerbated by the fact that the point toward which the ball must travel is usually relatively far away from the ball. This makes it difficult to judge a true line to this point. Thus, the notch on the putter head, if aligned at all, will be aligned on an inaccurate line.

What is needed, then, is a putter with only one long notch or edge for easier alignment, which can then be aligned with a putting line created over a shorter distance. This device is presently lacking in the prior art.

SUMMARY OF THE INVENTION

It is an object of this invention to provide a putter with an alignment means on the putting head by which the putting head can be aligned with a line running from a point near the hole through the golf ball to a point substantially behind the golf ball. The alignment means extends towards the back of the putting head, which allows the putting head to be aligned with the portion of the line between the ball and the point behind the ball. The point behind the golf ball is closer to the ball than the point near the hole, thus providing for a more accurate alignment between the putting head and the line.

It is a further object of this invention to provide a putter with an alignment means on the putting head of sufficient length to accurately align the putting head with the line on which the point behind the ball lies.

Yet another object of the present invention is to provide a putter with an integral alignment means with no visual distraction created by other linear edges or lines on the putter.

DESCRIPTION OF THE PREFERRED EMBODIMENT

The following description of a preferred embodiment of the invention deals with a putter for a right-handed golfer. All aspects of the invention can be applied to a putter for a left-handed golfer as well.

Figure 1:
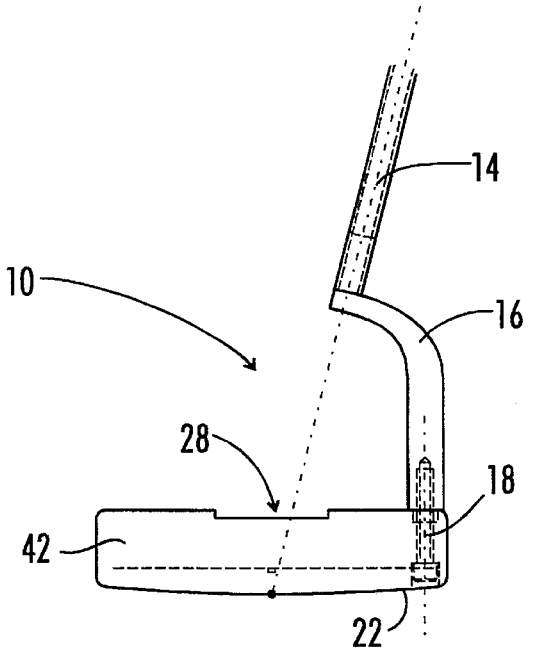
FIG. 1 is a front view of the putter of the present invention.

Referring now to the drawings, wherein like numerals represent like parts throughout, a preferred embodiment of the device of the present invention, a golf putter, is generally represented by the numeral 10. The golf putter 10 has a grip (not shown in any figure, but is a typical feature of every putter) attached to the upper or distal end of a shaft 14. The lower or proximal end of shaft 14 is secured by a connecting arm 16 to a putting head 22. The shaft 14 is attached to the connecting arm 16 and the connecting arm 16 is attached to the putting head 22 through a connecting bore by means of a conventional connecting device 18 such as a threaded end piece 18 (FIGS. 1 and 2).

Figure 2:
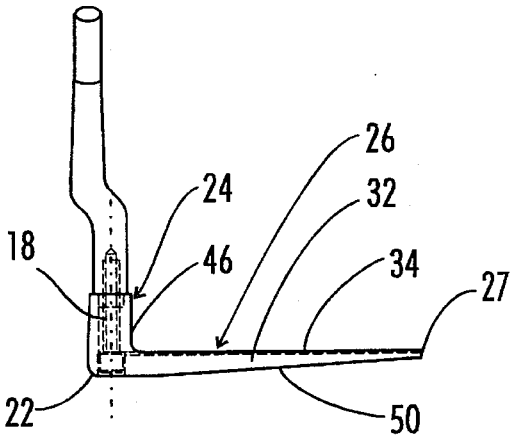
FIG. 2 is a right side view of the putter of FIG. 1
Figure 3:
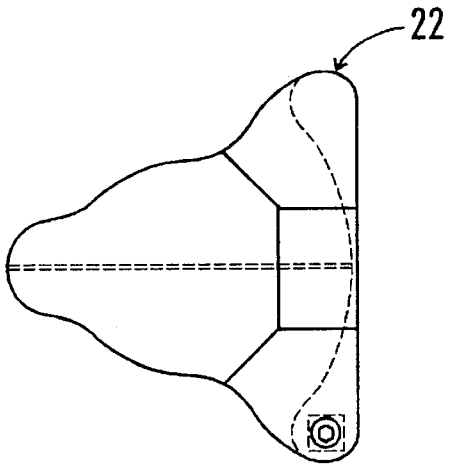
FIG. 3 is a bottom view of the putting head of the putter of FIG. 1.

Referring now to FIGS. 2 and 3, the putting head 22 includes a front section 24 rising vertically from a base 32, with the base 32 extending from the front section 24 to the back section 26 of the putting head 22. The lateral edge 36 of the base 32 is non-linear as it proceeds from the left lateral edge 38 of the front section 24, through the back end 27 of back section 26, to the right lateral edge 40 of front section 24.

Figure 4:
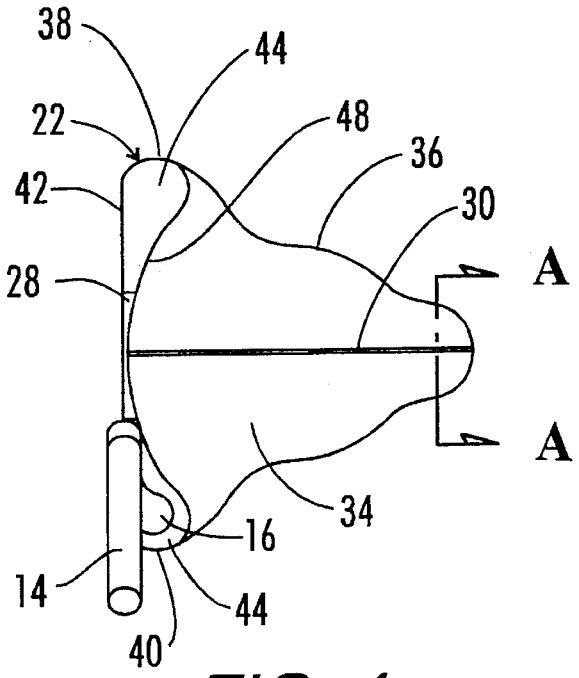
FIG. 4 is a top view of the putting head.
Figure 5:
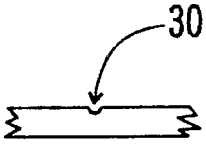
FIG. 5 is an enlarged rear view of a central portion of the putting head shown as line A—A on FIG. 4.

The front section 24 is defined by a front surface 42, a top surface 44, and a rear surface 46 (FIGS. 2 and 3). The connecting arm 16 is attached through the top surface 44 of front section 24 near its right lateral edge 40 (FIG. 4) The top surface 44 of front section 24 has a curved inner edge 48 that is centered within the width of the top surface 44 (FIG. 4).

The putting head 22 also includes a front section alignment gauge 28 formed centrally disposed on top surface 44 of the front section 24, directly behind front surface 42 (FIG. 4) The front section alignment gauge 28 is centered within the width of the front section 24 and is of a width comparable to the width of a standard golf ball. This front section alignment gauge 28 is used to align the front section 24 with the golf ball to insure square contact with the ball.

A novel rear alignment means defined by notch 30 extends along the top surface 34 of the base 32 from a point directly behind and perpendicular to rear surface 42 of front section 24, to back end 27 of back section 26 of the putting head 22. In accordance with one of the objects of the invention, notch 30 forms the only visible linear margin or edge on this surface. The rear alignment notch 30 is used to align the putting head 22 with a line through the center of the golf ball through a point substantially behind the ball.

The rear alignment notch 30 is of a length sufficient to accurately align the putting head 22 with the line from the point directly behind the golf ball through the point substantially behind the ball. In a preferred embodiment of this invention, this length is approximately five inches.

The putting head 22 has a bottom surface 50 which proceeds on an angle of approximately 2.4° away from horizontal, from front section 24 toward back section 26 (FIG. 2) and toward ends 38 and 40.

The front surface 42 of front section 24 proceeds upward from the bottom plane of the putting head 22 at an angle approximately 3° away from a plane perpendicular to the bottom plane, in a direction towards the back section 26 of putting head 22.

Figure 6:
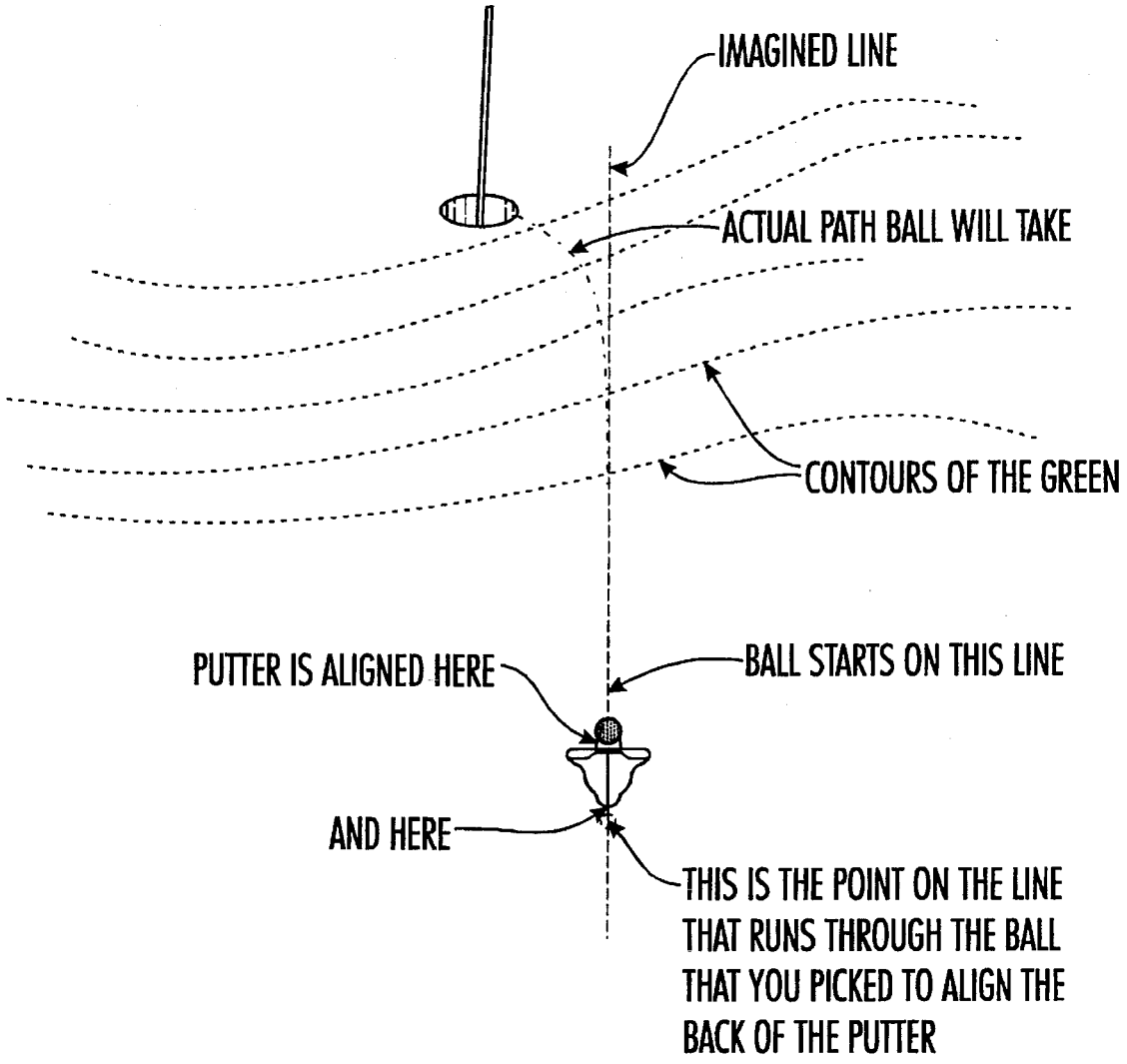
FIG. 6 is a plan view of the putter alignment means in use.

For full effect of the above features, the putter of the preferred embodiment should be used as shown on FIG. 6. The golfer should first analyze the contours of the green to determine which way the ball will break after it is struck by the putter. The golfer should then choose a target point near the hole at which to aim the ball. Then, a line from the ball to the target point should be identified. Then, the mental line should be continued through the center of the ball to a point substantially behind the ball. The point substantially behind the ball could be marked by such things as a blade of grass, a clover leaf, a brown spot, dead grass, spike mark, or a shadow.

The front section 24 of the putting head 22 should be aligned with the golf ball using the front section alignment gauge 28 to insure square contact with the golf ball. The putting head 22 should then be aligned with the line through the center of the ball to the point substantially behind the ball using the rear alignment notch 30.

After the putting head 22 is aligned, the golfer should stare at the rear alignment notch 30. It is now in the position necessary to insure that the ball will start traveling on the line to the point chosen near the hole. The golfer should then take a normal putting stroke, keeping the rear alignment notch 30 in the same position. The golfer should then watch the ball follow the line and proceed into the hole.

Thus, although there have been described particular embodiments of the present invention of a new and useful "Rear Alignment Putter", is not intended that such references be construed as limitations upon the scope of this invention except to set forth the following claims. Further, although there have been described certain dimensions used in the preferred embodiment, it is not intended that such dimensions be construed as limitations upon the scope of this invention except to set forth the following claims.

What I claim is:

1. An improved golf putter including a grip, a shaft, a connecting arm, and a putting head having an upstanding front section including a ball striking surface and a back section at a lower elevation than a top surface of said front section, said improvement comprising:

a. a rear alignment notch used to align said putting head with a line through the center of a golf ball to a point substantially behind the golf ball and behind said putter, said rear alignment notch extending along a top surface of said back section of said putting head from a point directly behind a rear surface of said front section to a back end of said back section of said putting head;

b. said rear alignment notch extending for a length of sufficient distance to accurately align said putting head with said line; and c. all visible edges beginning at the rear of said ball striking face, excluding said connecting arm and said notch, being non-linear and symmetrical.

2. The putter described in claim 1 where said putting head has alignment indicia on said top surface of said front section, said alignment indicia lying directly behind said ball striking face of said front section, said alignment indicia used to align said front section to said golf ball, said alignment indicia being of a width similar to said golf ball.

3. The putter described in claim 1 where said length of said rear alignment notch is at least three inches.

* * * * *